US006682204B2

(12) United States Patent
Mullally et al.

(10) Patent No.: US 6,682,204 B2
(45) Date of Patent: Jan. 27, 2004

(54) LIGHTING UNIT WITH MOUNTING MECHANISM

(75) Inventors: Jeffrey Mullally, Milford, CT (US); Willfred Goldschmidt, Weston, CT (US); Irving Schaffer, Fairfield, CT (US)

(73) Assignee: Hubbell Incorporated, Orange, CT (US)

( * ) Notice: Subject to any disclaimer, the term of this patent is extended or adjusted under 35 U.S.C. 154(b) by 0 days.

(21) Appl. No.: 10/138,427

(22) Filed: May 6, 2002

(65) Prior Publication Data

US 2003/0206416 A1 Nov. 6, 2003

(51) Int. Cl.[7] ..... F21V 21/00

(52) U.S. Cl. ..... 362/249; 362/329; 362/374; 362/431

(58) Field of Search ..... 362/240, 241, 362/242, 243, 247, 249, 431, 410, 326, 327, 328, 329, 362, 370, 373, 374

(56) References Cited

U.S. PATENT DOCUMENTS

| | | | | |
|---|---|---|---|---|
| 2,178,087 A | | 10/1939 | Venting | |
| D223,440 S | | 4/1972 | Noyes | |
| D226,778 S | | 4/1973 | Breed et al. | |
| D230,071 S | | 1/1974 | Anderson | |
| 4,225,909 A | | 9/1980 | Scholz et al. | |
| 4,264,945 A | | 4/1981 | Ullman | |
| 4,787,019 A | | 11/1988 | van den Broeke | |
| 4,847,741 A | | 7/1989 | Boettinger | |
| D313,194 S | | 12/1990 | Francisco | |
| D322,584 S | | 12/1991 | Kawashima et al. | |
| 5,947,588 A | * | 9/1999 | Huang | 362/235 |
| 6,183,100 B1 | * | 2/2001 | Suckow et al. | 362/35 |
| D439,858 S | | 4/2001 | Decosse | |
| 6,213,395 B1 | | 4/2001 | Dejaeger et al. | |
| 6,265,984 B1 | | 7/2001 | Molinaroli | |
| 6,357,902 B1 | * | 3/2002 | Horowitz | 362/545 |
| 6,491,417 B1 | * | 12/2002 | Haen et al. | 362/485 |

* cited by examiner

*Primary Examiner*—Sandra O'Shea
*Assistant Examiner*—John Anthony Ward
(74) *Attorney, Agent, or Firm*—Tara L. Hoffman; Alfred N. Goodman

(57) ABSTRACT

A lighting unit including a housing that has a base and opposing cover that is coupled to the base. A is lens disposed between the base and cover to form an inner receiving area. A light support member is disposed in the inner receiving area and supports a plurality of light sources. An axial opening extends through each of the cover and base, respectively. The axial opening has a central opening portion for receiving a support structure and an access opening portion. A mounting segment is releasably engagable with the housing and receivable in the access opening portion of the housing whereby removal of the segment provides access to the central opening portion and allows mounting of the housing on the support structure.

27 Claims, 3 Drawing Sheets

LIGHTING UNIT WITH MOUNTING MECHANISM

BACKGROUND OF THE INVENTION

Many commercial establishments use light fixtures mounted to a power pole since the pole provides both communication and power wiring, and a convenient place for supporting the light fixture. For example, stores with check out registers require a power pole for supplying communication and power wiring to the register as well as a register light to indicate when the register is open, closed, or assistance is required.

However, conventional register lights can be difficult to mount directly on the power pole, particularly after the power pole has been installed. For example, some conventional register lights must be disassembled and then reassembled on the power pole thereby requiring many steps to mount the register light. This can also result in a less aesthetically pleasing light due to the appearance of multiple parts assembled together. Also, several additional parts are often required to mount the register light.

Examples of conventional register lights and light fixtures include U.S. Pat. No. 6,265,984 to Molinaroli; U.S. Pat. No. 4,264,945 to Ullman; U.S. Pat. No. 4,225,909 to Scholz et al.; the subject matter of each of which is herein incorporated by reference.

SUMMARY OF THE INVENTION

Accordingly, an object of the present invention is to provide a lighting unit that is easily mounted on a support structure, such as a power pole.

Another object of the present invention is to provide a lighting unit that can be mounted to a support structure, such as a power pole, either before or after the power pole has been installed.

Yet another object of the present invention is to provide a lighting unit that requires only a few steps to mount the lighting unit on a support structure, such as a power pole, and does not require multiple additional parts to mount the lighting unit.

Still another object of the present invention is to provide a lighting unit that once mounted on a support member, such as a power pole, provides an aesthetically pleasing appearance.

The foregoing objects are basically attained by a lighting unit including a housing that has a base and opposing cover that is coupled to the base. A lens disposed between the base and cover to form an inner receiving area. A light support member is disposed in the inner receiving area and supports a plurality of light sources. An axial opening extends through each of the cover and base, respectively. The axial opening has a central opening portion for receiving a support structure and an access opening portion. A mounting segment is releasably engagable with the housing and receivable in the access opening portion of the housing whereby removal of the segment provides access to the central opening portion and allows mounting of the housing on the support structure.

The foregoing objects are also attained by a method of mounting a lighting unit to a support member, including the steps of placing the lighting unit in a first direction on the support member that is substantially traverse to a longitudinal axis defined by the support member, so that the support member passes through an access opening portion defined in the lighting unit and is received in a central opening portion contiguous with the access opening portion. The method also includes the steps of securing the lighting unit to the support member and inserting a mounting segment into the access opening portion, thereby enclosing the support member.

By fashioning and mounting the lighting unit in the above manner, the lighting unit can be easily mounted to a support member, such as a support pole, with a limited number of steps, particularly when the power pole is already installed.

Other objects, advantages and salient features of the invention will become apparent from the following detailed description, which, taken in conjunction with annexed drawings, discloses a preferred embodiment of the present invention.

BRIEF DESCRIPTION OF THE DRAWINGS

Referring to the drawings which form a part of this disclosure.

DETAILED DESCRIPTION OF THE INVENTION

Referring to FIGS. 1–5, a lighting unit 10 in accordance with an embodiment of the present invention generally includes a housing 12 and a removable mounting segment 14 for facilitating mounting of lighting unit 10 onto a support member 16 regardless of whether support member 16 is installed or secured to support structures.

Figure 1:
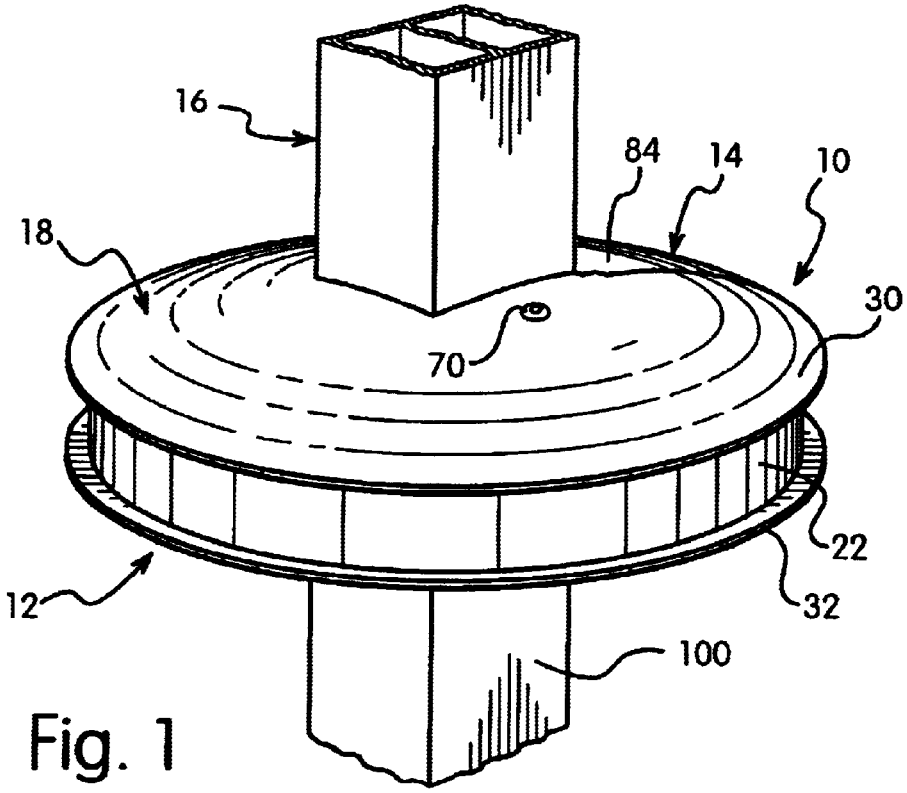
FIG. 1 is a perspective view of a lighting unit in accordance with an embodiment of the present invention showing the lighting unit mounted on a support member.
Figure 2:
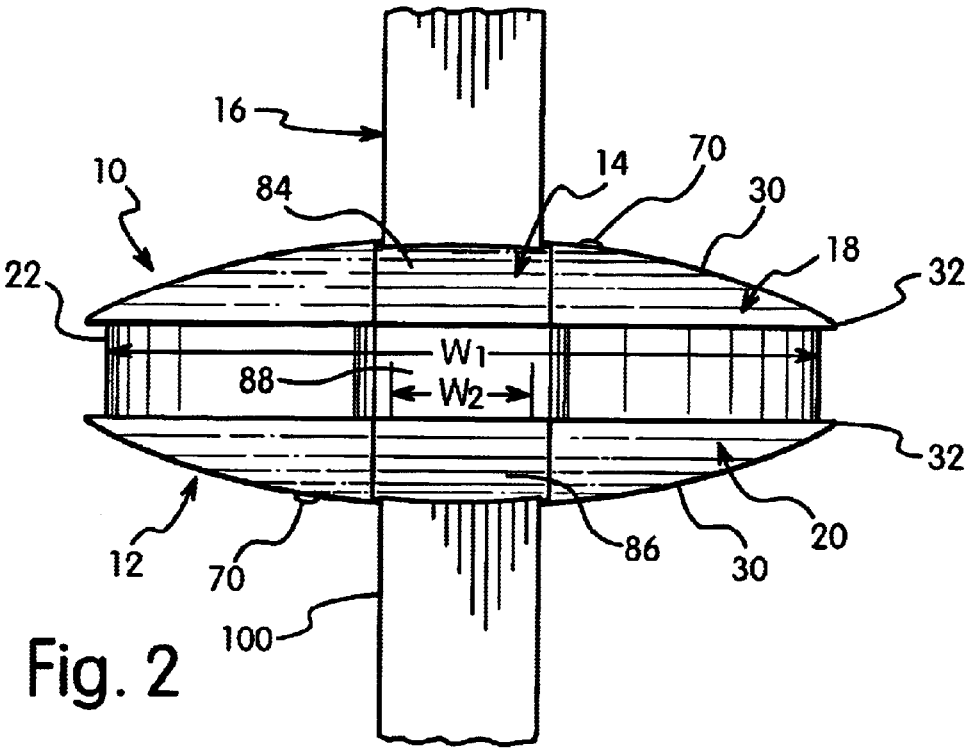
FIG. 2 is a side elevational view of the lighting unit illustrated in FIG. 1, showing a segment of the lighting unit inserted in place.
Figure 3:
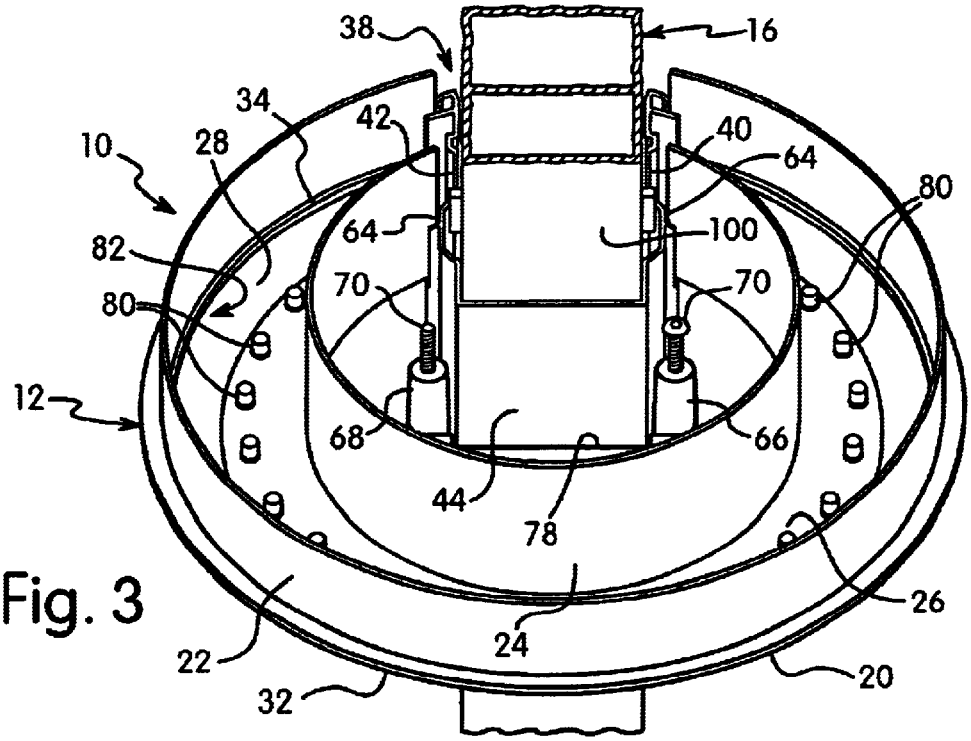
FIG. 3 is a top perspective view of the lighting unit illustrated in FIG.1, with a cover of the lighting unit removed.
Figure 4:
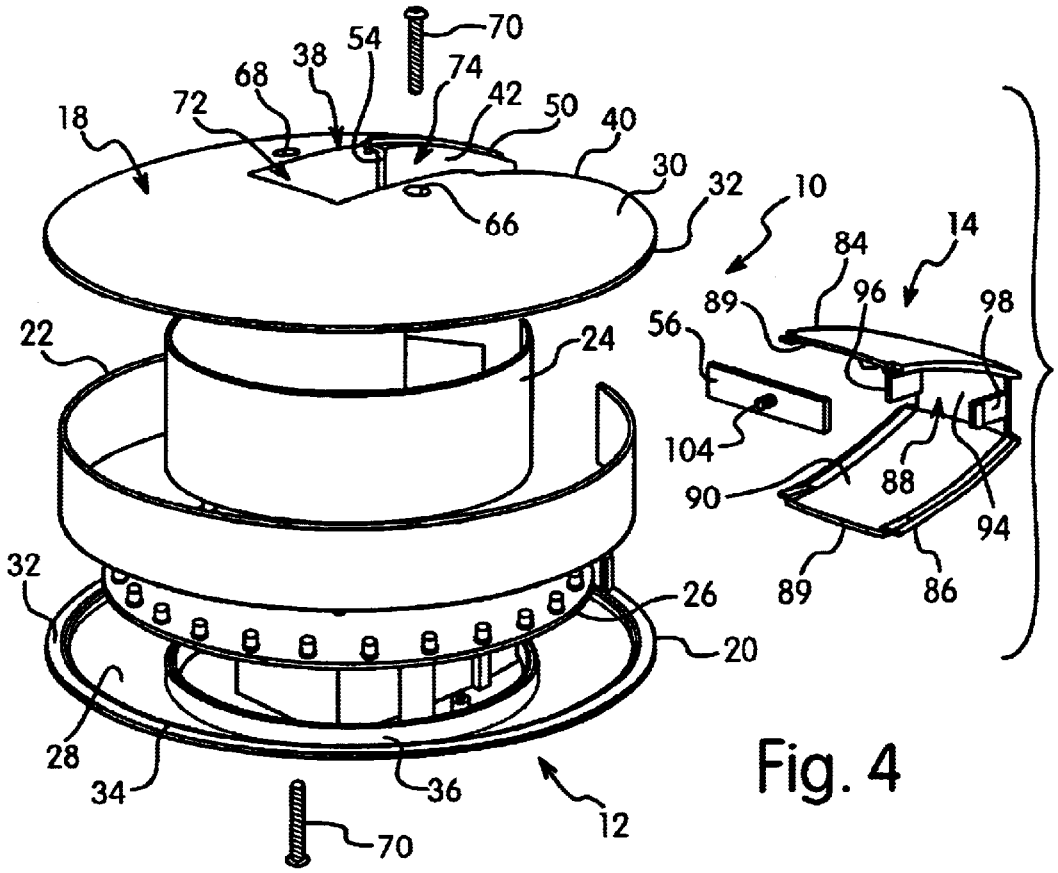
FIG. 4 is an exploded perspective view of the lighting unit illustrated in FIG. 1.

Housing 12 of lighting unit 10 includes a cover 18 and a base 20 with a lens 22, reflector 24, and light support 26 disposed therebetween, as best seen in FIGS. 3 and 4. Cover 18 and base 20 are substantially identical and thus the same reference numerals will be used to describe both. In particular, base 20 is inverted and mates with cover 18 to form housing 12. Each of cover 18 and base 20 preferably has a generally disc or circular shape with inner and outer surfaces 28 and 30. Inner surface 28 is generally concave and outer surface 30 is generally convex creating a dome shape. Although it is preferable that cover 18 and base 20 have a circular and dome shape, cover 18 and base 20 can have any shape such as a planar square or rectangular shape. Likewise, although housing 12 is preferably round or disc shaped, as seen in FIGS. 1–5, housing 12 can be various shapes such as any circular or polygonal shape. For example, cover 18 and base 20 can be substantially square with lens 22 and light support 26 also being substantially square to conform to the shape of cover 18 and base 20.

Each of the cover 18 and base 20 defines an outer perimeter 32 with a concentric lens receiving groove 34 located near outer perimeter 32 and extending inwardly from inner surface 28. Spaced from lens receiving groove 34 is a second concentric groove 36 located near the center of each of cover 18 and base 20, as best seen in FIG. 4.

Figure 5:
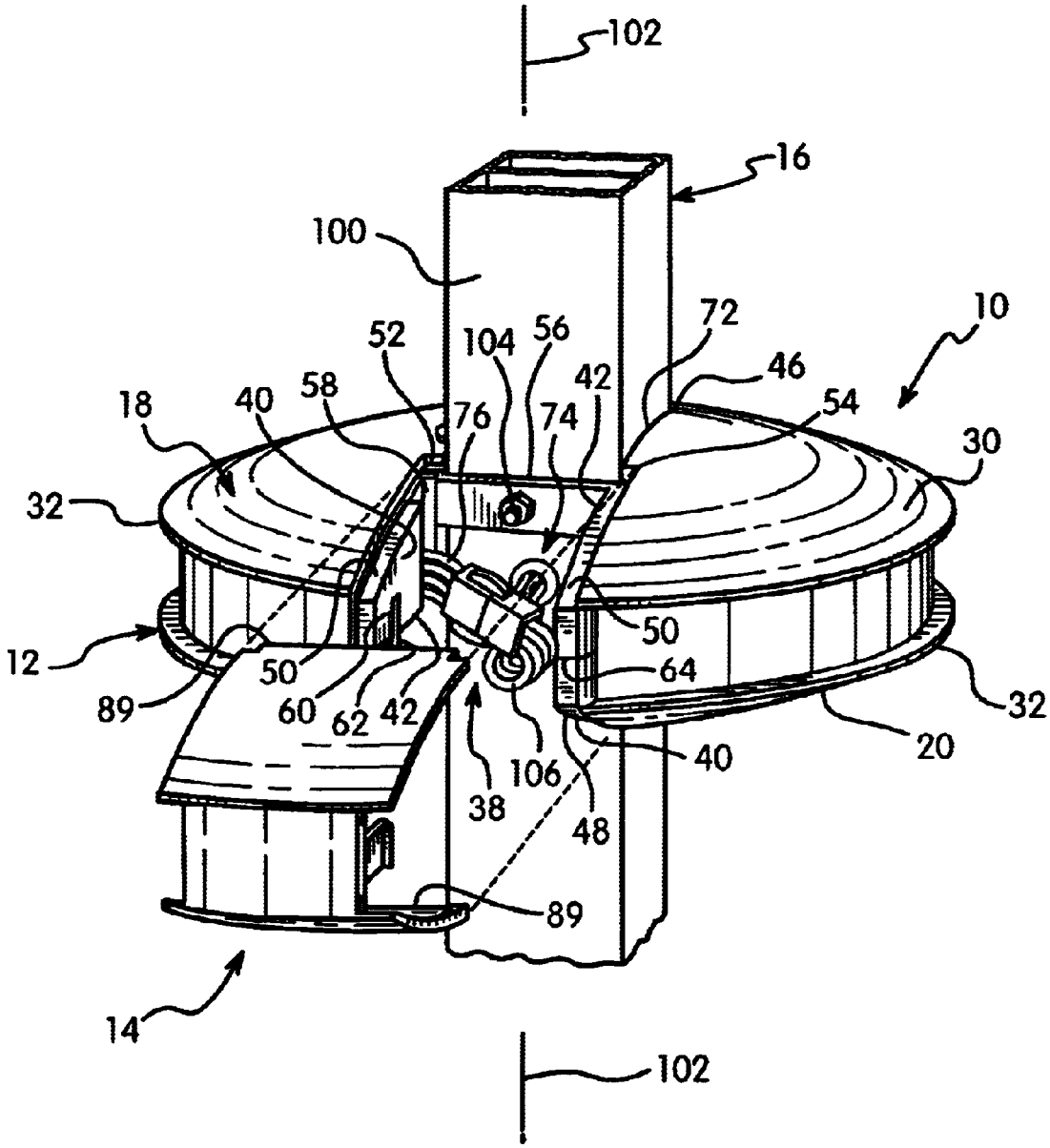
FIG. 5 is a perspective view of the lighting unit illustrated in FIG. 1, showing the segment of the lighting unit being inserted into place.

As seen in FIGS. 3–5, an axial opening 38 is defined in cover 18 and base 20 by three depending walls extending from each of cover 18 and base 20 including first and second substantially parallel sidewalls 40 and 42 with a third end wall 44 extending between sidewalls 40 and 42 at a closed end 46. Opposite closed end 46 is an open end 48 providing access to axial opening 38. Outer surfaces 50 of each sidewall 40 and 42 are adapted to engage segment 14. Also, as best seen in FIG. 5, sidewalls 40 and 42 include corresponding first slots 52 and 54, respectively, for receiving a clamping member 56. Additionally, one or both of sidewalls 40 and 42 can include a wire receiving groove 58 for facilitating mounting of lighting unit 10 without damaging the wiring 76 of lighting unit 10, as seen in FIG. 5 (showing groove 58 in sidewall 40 only). Second slots 60 and 62 are spaced from first slots 52 and 54 on each sidewall 40 and 42, respectively, for mating with segment 14. Since base 20 is inverted, second slot 60 of cover first sidewall 40 aligns with second slot 62 of base second sidewall 42, as seen in FIG. 5.

Free edges 64 of sidewalls 40 and 42 and end wall 44 of each of cover 18 and base 20 abut one another when base 20 is inverted and mated with cover 18, as best seen in FIG. 5. Two fastener holes 66 and 68 are located on either side of first and second sidewalls 40 and 42 of each of cover 18 and base 20. Fastener holes 66 and 68 align with each other to received fasteners 70 to mate cover 18 and base 20.

Axial opening 38 includes two contiguous portions, a central opening portion 72 and an access opening portion 74. Central opening portion 72 is adapted and shaped to receive support member 16 and access opening portion 74 is adapted and shaped to receive segment 14. Although the shape of axial opening 38, defined by sidewalls 40 and 42 and end wall 44, is generally rectangular or square in cross section or plan view to conform to the generally square shape of support member 16, axial opening 38 can be various shapes such as circular, triangular, or trapezoidal. Support member 16 can also be various shapes such as circular, triangular or trapezoidal as long as support member can be received in axial opening 38.

As seen in FIGS. 3 and 4, lens 22 is a transparent or opaque circular band received in lens receiving groove 34 of each of cover 18 and 20 so that lens 22 extends between cover 18 and base 20 and substantially encloses housing. Preferably, lens 22 is made of an acrylic material and diffuses light rays from light sources 80 disposed on light support 26, thereby creating an even illumination. An inner receiving area 82 is generally defined between cover 18, base 20 and lens 22.

Light support 26 is received within inner receiving area 82 and rests on base inner surface 28, particularly on second concentric groove 36. Light support 26 is preferably an electronic circuit board that supports a plurality of light sources 80, such as light emitting diodes (LEDs). Although light sources 80 are preferably LEDs, other light sources can be used such as conventional lamps or bulbs. Also, including a plurality of light sources 80 is preferable, however, only one light source is required. Light support 26 is circular with a center opening 78 axially aligned with central opening portion 72 of cover 18 and base 20 for receiving support member 16 and first and second sidewalls 40 and 42 and end wall 44 of both cover 18 and cover 20. Preferably, LEDs 80 form a concentric circle with LEDs 80 being radially disposed around central opening 78, as best seen in FIG. 3. Wiring 76 electrically connects light sources 80 with a power source, as seen in FIG. 5.

Reflector 24 is also received in inner receiving area 82 and is disposed between light support 26 and cover 18. In particular, reflector 26 is spaced inwardly from lens 22 and rests on light support 26 so that LEDs 80 are located between reflector 24 and lens 22, as seen in FIG. 3. Reflector 24 is received in second concentric groove 36 extending from cover inner surface 28 when cover 18 and base 20 are mated thus securing reflector 24 in place. Reflector 24 is a reflective circular band that extends between cover 18 and base 20. Preferably, reflector 24 is formed of a reflective cardboard or a textured foil.

As seen in FIGS. 4 and 5, segment 14 includes opposing first and second walls 84 and 86 with a third end wall 88 extending therebetween. Each wall 84, 86 and 88 is rectangular in shape with first and second walls 84 and 86 being slightly curved forming a generally C-shape in cross section. Segment 14 is adapted and shaped to fit into access opening portion 74 of cover 18 and base 20 in a transverse direction with first wall 84 engaging cover 18, second wall 86 mating with base 20. Inner ends 89 of each of segment walls 84 and 86 and remote from end wall 88 are preferably adjacent support member 16. Segment 14 can have various shapes such as circular, triangular or trapezoidal in plan view, as along as the shape conforms to the shape of access opening portion 74. Preferably, inner ends 89 of segment 14 are substantially straight to conform to the generally square shape of support member 16, outer end wall 88 is substantially curved to conform to the curvature of housing 12, and segment 14 is substantially square or rectangular in plan view, as seen in FIGS. 2 and 5. Also, if support member 16 has a circular shape, for example, the inner ends 89 of segment 14 would be substantially curved.

Segment 14 is generally small relative to housing 12, so that once segment 14 is received in housing 12, segment 14 is about 20–30 degrees of the 360 degrees of the circumference of lighting unit 10. As seen in FIG. 2, the width W2 of segment 14 is substantially less than the width W1 of housing 12 of lighting 10. Also, the width W2 is preferably just large enough to receive support member 16.

Each wall 84, 86 and 88 includes an inner surface 90, 92 and 94, respectively. Extending from inner surface 94 of end wall 88 are first and second snapping members 96 and 98 for engagement with second slots 60 and 62 of first and second sidewalls 40 and 42, respectively, of cover 18 and base 20. Preferably, first and second snapping members 96 and 98 are hooks or tabs with a catch at an end. However, any known attachment or engagement members can be used with segment 14 to couple segment 14 with housing 12.

Assembly and Operation

Referring to FIGS. 1–5, assembly of lighting unit 10 initially requires assembly of housing 12 by inverting base 20 and placing lens 22 in lens receiving groove 34, light support 26 on second concentric groove 36 of base 20, and reflector 24 on light support 26 with light sources 80 being between lens 22 and reflector 24, as seen in FIG. 3. Cover 18 can then be placed on base 20 so that free edges 64 of first and second depending sidewalls 40 and 42 and end wall 44 of each of cover 18 and base 20 abut one another. In particular, since base 20 is inverted the free edges 64 of cover depending first and second sidewalls 40 and 42 will abut free edges 64 of base second and first sidewalls 42 and 40, respectively. Lens 22 is received in lens receiving groove 34 of both cover 18 and base 20 and reflector 24 is received in second concentric groove 36 of cover 18. Fasteners 70 can then be inserted through fastener holes 66 and tightened to mate cover 18 and base 20.

As seen in FIG. 5, lighting unit 10 can be mounted to support member 16 from a side 100 of support member 16, in a direction traverse to longitudinal axis 102 of support member 16, rather than an end (not shown) of support member 16. This is particularly advantageous when support member 16, such as a power pole, is already installed in place, for example adjacent a cash register in a store with the ends of the power pole secured to supporting structures, so that mounting of lighting unit 10 is limited to the sides 100 of support member 16. To mount lighting unit 10 on support member 16, segment 14 is removed or disengaged with housing 12, wiring 76 of light support 26 is placed in wire receiving groove 58 and housing 12 is placed on support member 16. With wiring 76 received in wire receiving groove 58, housing 12 can be placed on support member 16 without obstructing wiring 76. Housing 12 is placed on support member 16 in a direction generally traverse to a longitudinal axis 102 so that support member 16 first passes through open end 48, through access opening portion 74 and into central opening portion 72. Once support member 16 is received in central opening portion 72 of housing 12, housing 12 is secured to support member 16 by inserting clamp member 56, such as a clamp bar, in first slots 52 and 54 of first and second sidewalls 40 and 42 of cover 18. A fastener 104 can then be inserted through clamp member 56 and support member 16 thereby securing housing 12 to support member 16. Although it is preferable to use clamping member 56 and fastener 96 to secure housing 12 to support member 16, any known attachment can be used.

Once housing 12 is secured to support member 16, wiring 76 is connected to wiring 106 of a power source (not shown). Preferably, wiring 106 is received in and extends through support member 16 and connects to wiring 76 of lighting unit 10, as seen in FIG. 5. Segment 14 can then be inserted into access opening portion 74 to cover wiring 76 and wiring 106. Also, since segment 14 generally conforms to the shape of housing 12, lighting unit 10 has an aesthetically pleasing appearance of a one-piece continuous housing. In particular, first wall 84 fits into access opening portion 74 at cover 18 so that inner surface 90 rests on outer surfaces 50 of first and second depending sidewalls 40 and 42 of cover 18 with first wall 84 being substantially flush with cover 18, as seen in FIG. 2. Similarly, inner surface 92 of second wall 86 rests on outer surfaces 50 of first and second sidewalls 40 and 42 of base 20 with second wall 86 being substantially flush with base 20. Also, inner surface 94 of end wall 88 of segment 14 is generally flush with lens 22 with snapping members 96 and 98 engaging second slots 60 and 62 of first and second sidewalls 40 and 42 of both cover 18 and base 20. Although snapping members 96 and 98 are preferable, any known attachment can be used to couple segment 14 with housing 12.

Lighting unit 10 operates, for example, to indicate when a check our register is open or closed. Specifically, light unit 10 is illuminated via LEDs 80 when the check out register is open, turned off when the register is closed, and flashes twice when assistance is required.

To remove lighting unit 10 from support member 16, segment 14 is removed from access opening portion 74 by pulling with sufficient force to overcome the snapping engagement between snapping members 96 and 98 of segment 14 and second slots 60 and 62 of cover 18 and base 20. Wiring 76 of lighting unit 10 can then be disconnected from wiring 106 from the power source, allowing housing 12 to slide off support member 16 in a direction traverse to the support member longitudinal axis 102 so that support member 16 passes first through access opening portion 74 and then through open end 48.

While a particular embodiment has been chosen to illustrate the invention, it will be understood by those skilled in the art that various changes and modifications can be made therein without departing from the scope of the invention as defined in the appended claims.

What is claimed is:

1. A lighting unit, comprising;

a housing having a base and opposing cover coupled to said base, a lens disposed between said base and cover forming an inner receiving area, a light support member disposed in said inner receiving area and supporting at least one light source, and an axial opening extending through each of said cover and base, respectively, said axial opening having a central opening portion for receiving a support structure and a transversely directed access opening portion; and a mounting segment releasably engagable with said housing and receivable in said access opening portion of said housing, whereby removal of said segment provides access to said central opening portion and allows mounting of said housing on the support structure.

2. A lighting unit according to claim 1, wherein said segment is received in said access opening portion of said housing, substantially enclosing said central opening portion.

3. A lighting unit according to claim 1, wherein said segment engages each of said cover and base, respectively, at said access portion by a snapping engagement.

4. A lighting unit according to claim 1, wherein said segment includes first and second walls with an outer end wall extending therebetween; and said segment is received in said access opening portion of said housing so that said first wall is substantially flush with said cover, said second wall is substantially flush with said base, and said end wall is substantially flush with said lens.

5. A lighting unit according to claim 3, wherein said end wall includes a tab for snapping engagement with a slot disposed in each of said cover and base, respectively, at said access opening portion.

6. A lighting unit according to claim 1, wherein said housing is substantially larger than said segment.

7. A lighting unit according to claim 1, wherein said central opening portion and said access opening portion of said axial opening form one contiguous opening.

8. A lighting unit according to claim 1, wherein said access opening portion is open at an outer perimeter of each of said cover and base.

9. A lighting unit according to claim 1, wherein said inner receiving area of said housing includes a reflector; and said at least one light source comprising a plurality of light sources are located between said reflector and said lens.

10. A light unit according to claim 1, wherein said axial opening extends through said light support.

11. A lighting unit according to claim 1, wherein said light sources are concentrically disposed about said central opening portion of said housing.

12. A lighting unit according to claim 1, wherein said cover includes a groove for receiving power wires electrically connected to said light sources, said groove being located at said access opening portion.

13. A lighting unit according to claim 1, wherein said lens is disposed at an outer perimeter of each of said cover and base, respectively.

14. A lighting unit according to claim 13, wherein said lens is received in a concentric groove disposed in said base.

15. A lighting unit according to claim 13, wherein each of said cover and base have a substantially circular shape; and said lens is a continuous band formed of light diffusing material.

16. A lighting unit according to claim 13, wherein said base and cover are substantially identical.

17. A lighting unit according to claim 1, wherein said lens is substantially circular in plan view and has a central axis substantially corresponding to the central axis of said axial opening.

18. A lighting unit according to claim 1, wherein said central opening portion is substantially square in plan view;

said access opening portion is substantially square in plan view; and said segment is substantially square in plan view.

19. A lighting unit according to claim 18, wherein said segment has an inner end that is substantially straight and an outer end wall remote from said inner end that is substantially curved.

20. A lighting unit, comprising:

a housing having a base and opposing cover coupled to said base, a lens disposed between said base and cover forming an inner receiving area, a light support member disposed in said inner receiving area and supporting at least one light source, and an axial opening extending through each of said cover and base, respectively, said axial opening having a central opening portion for receiving a support structure and a transversely directed access opening portion; and a mounting segment releasably engaged with said housing and slidably received transversely into said access opening portion of said housing, and a width of said mounting segment is substantially less than a largest width of said housing, whereby removal of said segment provides access to said central opening portion and allows mounting of said housing on the support structure.

21. A lighting unit according to claim 20, wherein said segment is substantially square in plan view.

22. A lighting unit according to claim 21, wherein each of said base and cover of said housing is substantially circular and includes a curved outer perimeter.

23. A lighting unit according to claim 22, wherein said segment has an inner end that is substantially straight and an outer end wall remote from said inner end that is substantially curved to conform to the curvature of said outer perimeter of each of said base and cover, respectively.

24. A method of mounting a lighting unit to a support member, comprising the steps of:

placing the lighting unit in a first direction on the support member, with the first direction being substantially traverse to a longitudinal axis defined by the support member, so that the support member passes through an access opening portion defined in the lighting unit and is received in a central opening portion contiguous with the access opening portion;

securing the lighting unit to the support member; and inserting a mounting segment into the access opening portion, thereby enclosing the support member.

25. A method according to claim 24, further comprising the step of removing the segment from the access opening portion of the lighting unit prior to placing the lighting unit on the support member.

26. A method according to claim 24, further comprising the step of electrically connecting a plurality of light sources of the lighting unit to a power source prior to inserting the segment into the access opening portion.

27. A method according to claim 26, further comprising the step of placing power wires electrically connected to the plurality of light sources into a groove formed in the base at the access opening portion prior to placing the lighting unit onto the support member.

* * * * *